US007013507B2

(12) United States Patent
Cook

(10) Patent No.: US 7,013,507 B2
(45) Date of Patent: Mar. 21, 2006

(54) SLUMBER BAG

(76) Inventor: Teresa Cook, 25 Petworth Road, Brampton, Ontario (CA) L6Z 4C7

( * ) Notice: Subject to any disclaimer, the term of this patent is extended or adjusted under 35 U.S.C. 154(b) by 0 days.

(21) Appl. No.: 10/810,561

(22) Filed: Mar. 29, 2004

(65) Prior Publication Data

US 2005/0210583 A1 Sep. 29, 2005

(51) Int. Cl.
*A47G 9/08* (2006.01)

(52) U.S. Cl. ..... 5/413 R; 5/494; 5/655; 2/69.5

(58) Field of Classification Search ..... 5/413 R, 5/494, 655; 2/69.5
See application file for complete search history.

(56) References Cited

U.S. PATENT DOCUMENTS

| | | | | | |
|---|---|---|---|---|---|
| 1,940,224 | A | | 12/1933 | Munro | |
| 2,101,701 | A | | 12/1937 | Cohen | |
| 2,292,600 | A | | 8/1942 | Baum | |
| 2,355,138 | A | | 8/1944 | Bell | |
| 2,439,101 | A | | 4/1948 | Rogers | |
| D154,222 | S | * | 6/1949 | Tanner | D2/747 |
| 2,888,009 | A | | 5/1959 | Taylor | |
| 2,908,912 | A | | 10/1959 | Darling | |
| 3,521,309 | A | | 7/1970 | Evans | |
| 3,845,513 | A | | 11/1974 | Hubner | |
| 3,872,524 | A | | 3/1975 | Hummel | |
| 4,087,874 | A | | 5/1978 | Callaway et al. | |
| 4,124,908 | A | * | 11/1978 | Burns et al. | 5/628 |
| D267,284 | S | * | 12/1982 | Andrews | D2/719 |
| D269,474 | S | | 6/1983 | Mundy | |
| 4,688,282 | A | | 8/1987 | Jeffries | |
| D304,256 | S | * | 10/1989 | McEntee | D2/719 |
| 5,226,193 | A | | 7/1993 | Chen | |
| 5,243,724 | A | * | 9/1993 | Barnes | 5/482 |
| 5,416,938 | A | | 5/1995 | Li | |
| D365,915 | S | | 1/1996 | Merkley et al. | |
| 5,933,886 | A | | 8/1999 | Washington | |
| D422,775 | S | | 4/2000 | Hurr | |
| D423,760 | S | | 5/2000 | Sorenson | |
| 6,105,168 | A | * | 8/2000 | Hazen | 2/69.5 |
| 6,199,232 | B1 | * | 3/2001 | Kocivar | 5/502 |
| 6,266,822 | B1 | | 7/2001 | Joyce | |
| 6,421,852 | B1 | * | 7/2002 | Shao | 5/413 R |

* cited by examiner

*Primary Examiner*—Michael Trettel
(74) *Attorney, Agent, or Firm*—Marks & Clerk

(57) ABSTRACT

A slumber bag for a small child is provided having a quilted fabric front and back panel which are preferably connected to form a bag, and preferably at least two straps at or near an upper opening in the bag. The straps act to hold the bag in place on the child. Preferably, the straps extend from one panel to the other, around the sides of the slumber bag, and preferably, the straps are adjustable and are releasable connected using parachute clips. The slumber bag effectively covers the legs and lower torso of the child, and while easily removable by a care-giver, resists inadvertent removal by the child.

7 Claims, 5 Drawing Sheets

SLUMBER BAG

FIELD OF THE INVENTION

The present invention relates to the field of an essentially closed cover for a sleeping child, and in particular, a "slumber bag" which is adapted to stay in place as the child moves.

BACKGROUND OF THE INVENTION

It is a very general problem, for many families with young children, that the children will sometimes inadvertently or intentionally kick off their blanket or quilt because they feel relatively warm. Also, when the child moves or otherwise changes position during the night, the blanket or quilt will also shift its position and can sometimes slip off their body. Becoming uncovered by the blanket or quilt can result in the child's body temperature dropping after they fall asleep, and/or as the room temperature drops. Therefore, the children will have a more restless sleep, may wake during the night, and/or be more susceptible to illness.

Various approaches have been developed to hold the blanket, quilt, sleepwear, or other coverings on the child as they sleep. These approaches are described in, for example, a number of prior art documents. The following patents are illustrative of these attempts:

Munro, U.S. Pat. No. 1,940,224, issued Aug. 13, 1932, discloses a sleeping garment having an outer shell and an inner robe and hood combination, which robe/hood can be fastened to the inside of the outer shell using fasteners.

Bell, U.S. Pat. No. 2,355,138, issued Aug. 8, 1944, discloses a combination sleeping garment for infants, comprising a blanket and a jacket, which covers the arms and torso of the infant. The blanket has a means of being attached to a crib. The jacket may be attached to the blanket by a fastening means, for instance a zipper, thereby securing the infant under the blanket in a position where the infant's torso is fixed relative to the blanket. The infant may be placed in the jacket to allow either a face up or face down sleeping position when the jacket is fastened to the blanket.

Rogers. U.S. Pat. No. 2,439,101, issued Apr. 6, 1948, discloses a safety gown for bed patients and is particularly designed for infants to keep them covered and in a particular area of a bed, carriage or the like. The safety gown comprises a body portion including sleeves, where the body portion extends substantially to the waist of the infant. The remaining portion of the gown constitutes a sheet-like element which forms a long apron or blanket that covers the infant below the waist and which can be tucked in under a mattress or otherwise secured to maintain the infant in a predetermined area of the bed or carriage.

Taylor. U.S. Pat. No. 2,888,009, issued May 26, 1959, discloses an infant's sleeping bag which has ties at the four corners of the bag for attaching the garment to portions of the crib, bed, or the like upon which it is placed. The bag has an opening consisting of a neck opening and a slit, such that the slit can be closed by a fastening means, for instance a zipper. The infant's head is therefore held in position outside of the bag at the neck opening, while the remainder of the infant's body is held in the bag and covered from the neck down.

Evans, U.S. Pat. No. 3,521,309, issued Jul. 21, 1970, discloses a restraining sheet particularly adapted for use in cribs to maintain the desired sheet and blanket coverage over an infant. The restraining sheet is a combined pocket-containing crib sheet and blanket in which the crib sheet is placed over a mattress and preferably held in place by straps that are tied together. The blanket is attached to the pocket by a fastening means and thereby maintained in the desired position with respect to the pocket. The infant is placed in the pocket of the crib sheet for sleeping.

Hubner, U.S. Pat. No. 3,845,513, issued Nov. 5, 1974, discloses a sleeping bag in which a sleeping blanket is attached, in the area of the back, to a bedlinen sheet which can be stretched and fittedly attached to a crib mattress. The blanket contains a bodice-like upper portion with a zipper opening and a bag-like lower portion. A baby is placed in the bag either face up or face down, and the bag restrains the baby from standing up or removing the clothes.

Hummel, U.S. Pat. No. 3,872,524, issued Mar. 25, 1975, discloses a baby cover that comprises a jacket-shaped section that is continuous with a rectangular section, whereby the rectangular section is held on a mattress by fasteners at the corners and adapted to be attached to a crib by straps so as to prevent movement of the cover. A slit extends from the bottom of the jacket neck hole into a portion of the rectangular section, and is closed with a zipper, so that a baby is covered from the waist up in the jacket section of the cover, with the baby's lower body covered and held under the rectangular portion of the cover.

Jeffries, U.S. Pat. No. 4,688,282, issued Aug. 25, 1987, discloses bedding for children that comprises a generally rectangular blanket that has several fasteners on it. The blanket is can be wrapped around a child's torso, lower body and legs and held in place with fasteners on the side and bottom edges of the blanket. A pair of straps is located on the top edge of the blanket and to fit over the child's shoulders, and centrally located fastener is adapted to secure the blanket between the child's legs to prevent the blanket from being upwardly displaced.

Li, U.S. Pat. No. 5,416,938, issued May 23, 1995, discloses a fastener for preventing quilts from being kicked off. The fastener includes a wrapping sheet and a quilt which have corresponding hook-and-loop type fasteners for wrapping a child's body and firmly securing the quilt over the child.

Washington, U.S. Pat. No. 5,933,886, issued Aug. 10, 1999, discloses a blanket for snugly engaging the body of a baby. The blanket includes a bottom portion having a head end, a leg end, a torso section lying between the ends, and a pair of arms extending from opposite sides of the torso section. A top section covers the leg end and the torso section of the bottom portion, and is held in place by the arms of the bottom section, which extend through slots in the top section. The arms fasten together to secure the top and bottom portions of the blanket around a baby.

Joyce, U.S. Pat. No. 6,266,822, issued Jul. 31, 2001, discloses a sleepwear and secured blanket-like member wherein the child's sleepwear is fitted with a plurality of fasteners that can be attached to corresponding fasteners on the blanket-like member. The blanket-like member has a generally bag-like configuration similar to a "sleeping bag". For the purposes of this description, this bag-like structure will be described as a "slumber bag".

The prior art discussed hereinabove attempts to provide means for securing a covering to a sleeping person. However, they all suffer from limitations that can make them either impractical, or undesirable to use. These limitations include fasteners that are awkward to use, covers that can only be used when fitted to a mattress or other sleeping surface, covers that restrict a sleeping position to either face up or face down, covers that restrain or restrict a person's bodily movement so that the cover is uncomfortable as well as potentially unsafe to the person, or covers that require a matched set of sleepwear to be fitted to the cover.

Other problems include the fact that most of these type of blankets or covers are generally directed towards very young infants, and therefore, they may not be applicable for covering a slightly older child. For example, the fastener means for a 1 month old infant might not be suitable for use with a 36 month old child.

Further, as the size of the child increases, the fastener means must be adaptable to firmly hold a larger child. Typically, hook and eye fasteners may not be practical for all applications since generally, as the child's size increases, the amount of material used for holding the hook and eye fasteners decreases as the fasteners are adjusted to a larger size. Thus, as the child becomes older, and therefore larger and stronger, the amount of fastener material available decreases.

Accordingly, there remains a need in the art for a means of securing a blanket to a person's clothing that is both safe and easy to use, and which can be used over a wide range of child ages.

Accordingly, it would be advantageous to provide a cover, or a slumber bag, which can be fitted to a child and which will be held on the child while eliminating the need for coordinated sleepwear and blanket combinations, or the other devices described in the prior art.

SUMMARY OF THE INVENTION

Accordingly, it is an objective of the present invention to provide a sleeping cover or blanket for a young child, that includes a fastener means which will make it difficult for the cover or blanket to be kicked off either accidentally or intentionally.

It is a further objective of the present invention to provide a sleeping cover which is adjustable and therefore is adapted to be used with young children of various weights and sizes, with maintaining its ability to remain in place.

It is a still further objective of the present invention to provide a sleeping cover which is difficult for a child to remove, but which is easily removed by most adults or care-givers.

The advantages set out hereinabove, as well as other objects and goals inherent thereto, are at least partially or fully provided by the slumber bag of the present invention, as set out herein below.

Accordingly, in one aspect, the present invention provides a slumber bag for covering the legs and lower torso of a child comprising a cover portion having a front panel and a connected back panel, which front and back panels together define an opening at one end of the cover portion; and fitting straps located at or near said opening in order to partially close said opening, and wherein said fitting straps preferably comprises first and second straps on either said front and/or said back panels and at least one connector for releasably attaching said first and second straps together; and optionally adjustment means for adjusting the length of said first or second straps.

As such, the slumber bag preferably has a structure wherein the front and back panels are joined to one another around their circumference with the exception of the opening. Preferably, two back straps and two front straps are used, with a pair of front and back straps being used on each side of the slumber bag. The preferred connector for releasably attaching the front and back straps is commonly known as a "parachute" clip.

BRIEF DESCRIPTION OF THE DRAWINGS

Embodiments of this invention, will now be described by way of example only, in association with the accompanying drawings in which.

DETAILED DESCRIPTION OF THE PREFERRED EMBODIMENTS

Figure 1:
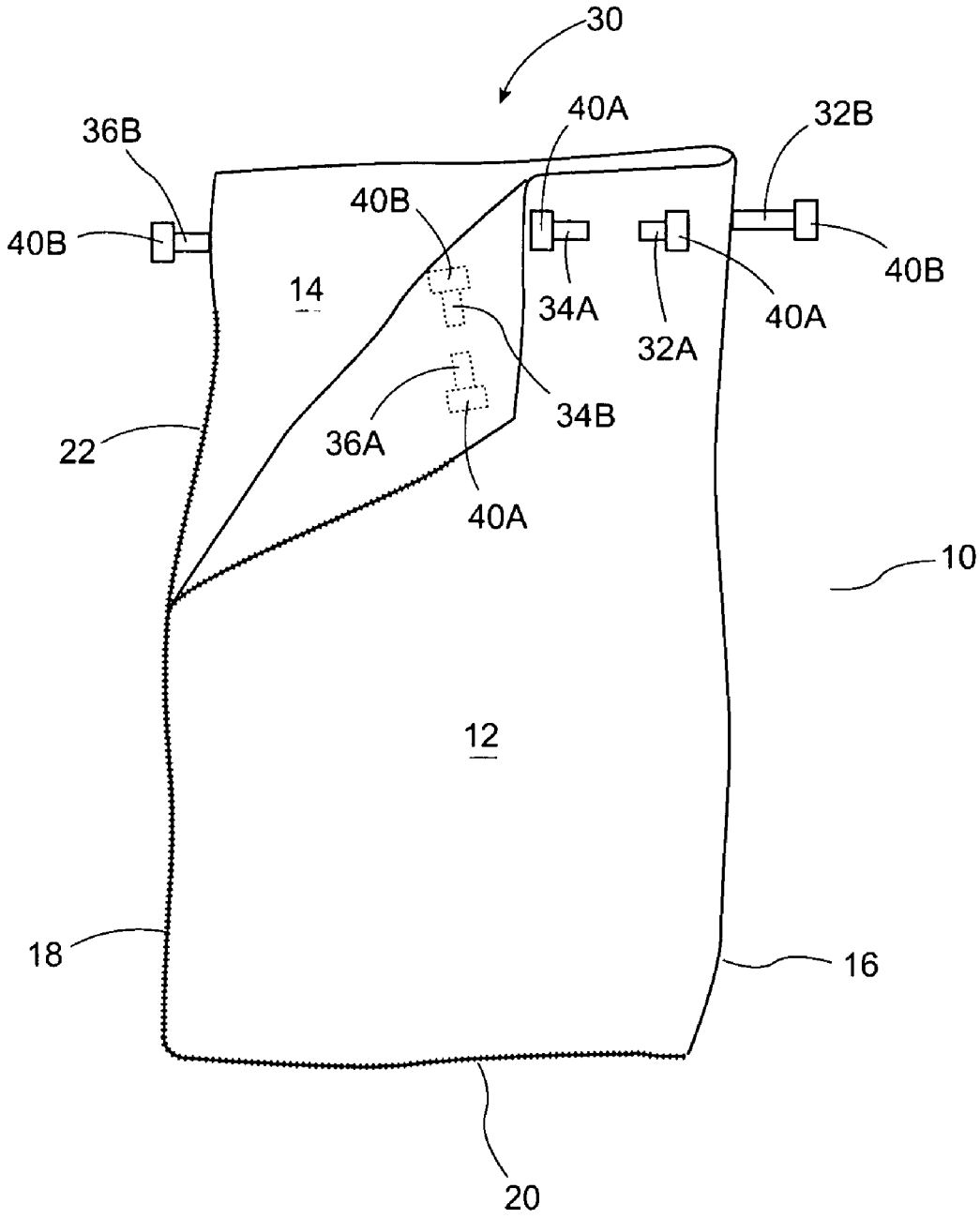
FIG. 1 is a perspective view of a slumber bag according to the present invention.

In the present application, the term "slumber bag" refers to a blanket arrangement or quilt arrangement used to cover the lower torso of a child. The "slumber bag" is somewhat similar to a sleeping bag, with the exception that it is intended to cover the lower body section, including the legs and the lower torso of the child, and it is held in place beneath the arms, and around the chest. The slumber bag is made of any suitable material which might be used as a blanket or cover. For example, this might include natural materials such as cotton, fleece, cotton flannel, silk, wool, or cloth, or synthetic materials such as nylon, polyester, or some combination thereof. Most preferably, the material is a quilted cotton flannel material having a polyester inner filling.

The slumber bag is intended for use with small children and as such, the child is preferably a child of less than 5 years of age. More preferably, the child is between 6 and 36 months of age, and most preferably, the child is between 12 and 36 months of age.

The novel features which are believed to be characteristic of the present invention, as to its structure, organization, use and method of operation, together with further objectives and advantages thereof, will be better understood from the following drawings. In the drawings, like reference numerals depict like elements.

It is expressly understood, however, that the drawings are for the purpose of illustration and description only and are not intended as a definition of the limits of the invention.

Referring to FIG. 1, a partially open slumber bag 10 is shown having a front panel 12 and a back panel 14. Front panel 12 and back panel 14 are joined together along a first, common side 16. This is conveniently accomplished by merely folding a larger panel in half to form side 16. Front and back panels 12, 14 are releasably attached to each other along a second, opposite side 18, and end 20. Several methods might be used to releasably attached front panel 12 to back panel 14, including hook and eye fasteners (e.g. "Velcro" fasteners), snap fasteners, clips, tie strings etc. However, as shown in FIG. 1, the front and back panels are preferably releasably held together using a zipper 22.

When closed, zipper 22 closes the end 20, and the majority of side 18. As such, an essentially enclosed slumber bag is produced which has an opening 30.

Slumber bag 10 is provided with three sets of straps designated as 32 (A & B), 34 (A & B), and 36 (A & B). Each strap pair has a two part parachute clip type connector 40 (A & B) which is used to releasably hold the ends of each strap pair together. Straps 32A, 34A and 36A are sewn so as to be effectively permanently attached to connector portions 40A. Straps 32B, 34B and 36B are slidably attached to connector 40B so that the effective length of straps 32B, 34B and 36B can be varied.

It should be noted that, in general, slumber bag 10 has a minimum of 1 pair of straps. While any number of straps might be used, preferably, between 2 and 4 pairs of straps are used. In a preferred embodiment, there are three straps, as shown in FIG. 1. The straps are generally orientated so as to be essentially parallel to the edge of opening 30 so that the opening is at least partially closed when the straps are pulled together, or shortened.

Also, while the connectors 40 for each strap pair might be located anywhere around opening 30, it is preferred that all of the connectors are located, in use, adjacent to front panel 12. In this fashion, the child can rest on his/her back on back panel 14 without resting on a connector 40.

The slumber bag of the present invention can have any dimensions suitable for use with a child of a selected age, size or weight. Typically, however, the slumber bag is between 18 inches and 36 inches wide, and between 30 and 48 inches long. Preferably, however, the slumber bag is between 22 and 26 inches wide, and between 30 and 40 inches long.

If the front and back panels are made by folding a common piece of fabric, so as to have one common side, then the fabric size will be double the relevant dimension of the slumber bag.

The length of the straps can vary depending on the number of straps on the slumber bag. Typically, however, the straps are between 1 and 14 inches in overall length, with a preferred length being between 6 and 11 inches. Further, preferably, straps 32B and 36B that pass from the back panel 12 to the front panel 14 are longer than strap 34B which is used solely on front panel 12 of slumber bag 10. The straps are preferably made of a plastic material such as nylon or polyester, although any suitable material might be used. A 1 inch wide strap is preferred, but this can vary depending on available materials.

In the preferred embodiment shown in FIG. 1, straps 32B and 36B are both attached to back panel 14, while straps 32A and 36A are attached to front panel 12. With this configuration, connecting straps 32A and 32B, and straps 36A and 36B, using connectors 40, and subsequently tightening combined straps 32 and 36 results in sides 16 and 18 being pulled into, and closing the sides of opening 30. With this configuration, the opening is closed by pulling on essentially the circumference of the opening, and thus avoids excessive "bunching" of fabric at the front of slumber bag 10. This arrangement allows for the provision of an essentially flat back panel on which the child can rest.

Strap 34 (parts A and B) is located entirely on the front panel 12, and provides additional adjustability of the size of opening 30.

In operation, the legs and lower torso of a child are inserted into opening 30, or zipper 22 can be completely opened so that the front and back panels are laid flat. The child can then be positioned on one panel, the other panel laid over the child, and the zipper closed. For correct positioning, the child is placed so that his/her arms are outside of the slumber bag, and the opening is closed around the chest of the child. The straps are drawn tight enough to hold the slumber bag in place, but not so tight as to cause any discomfort to the child. With this arrangement, the child is free to move their legs and/or torso, and the slumber bag will provide room for the leg movement, and/or will rotate with the child.

A key feature of the preferred embodiment of the present invention is the use of a strap connector which provides a strong connection, and which will not vary in strength depending on the size of the child. This could include strings, elastic ties, hook and eye fasteners, "double D" clips, buttons, snaps, and the like. However, a most preferred connector is a parachute clip.

Parachute clips have the advantage that they are easily adjustable. As such, the strap length can be adjusted. This is accomplished, however, without affecting the amount of effort required to release the parachute chip. Regardless of the length of the strap, the parachute clip mechanism is such that a certain amount of force and coordination are required to release the clip. Adults and other care-givers will typically have this strength and coordination, while children less than 3 or even 5 years old, likely will not have either the strength and/or coordination to release the clip. This is to be contrasted with hook and eye fasteners such as a Velcro fastener system where a young child will quickly learn that the straps can be easily released by merely applying a "tearing" force in a particular direction.

Since younger children will not have either the strength and/or the coordination to undo the parachute clip, the child cannot intentionally release the clip. Also, it is very unlikely that the parachute clip will become accidentally or inadvertently released.

Figure 2:
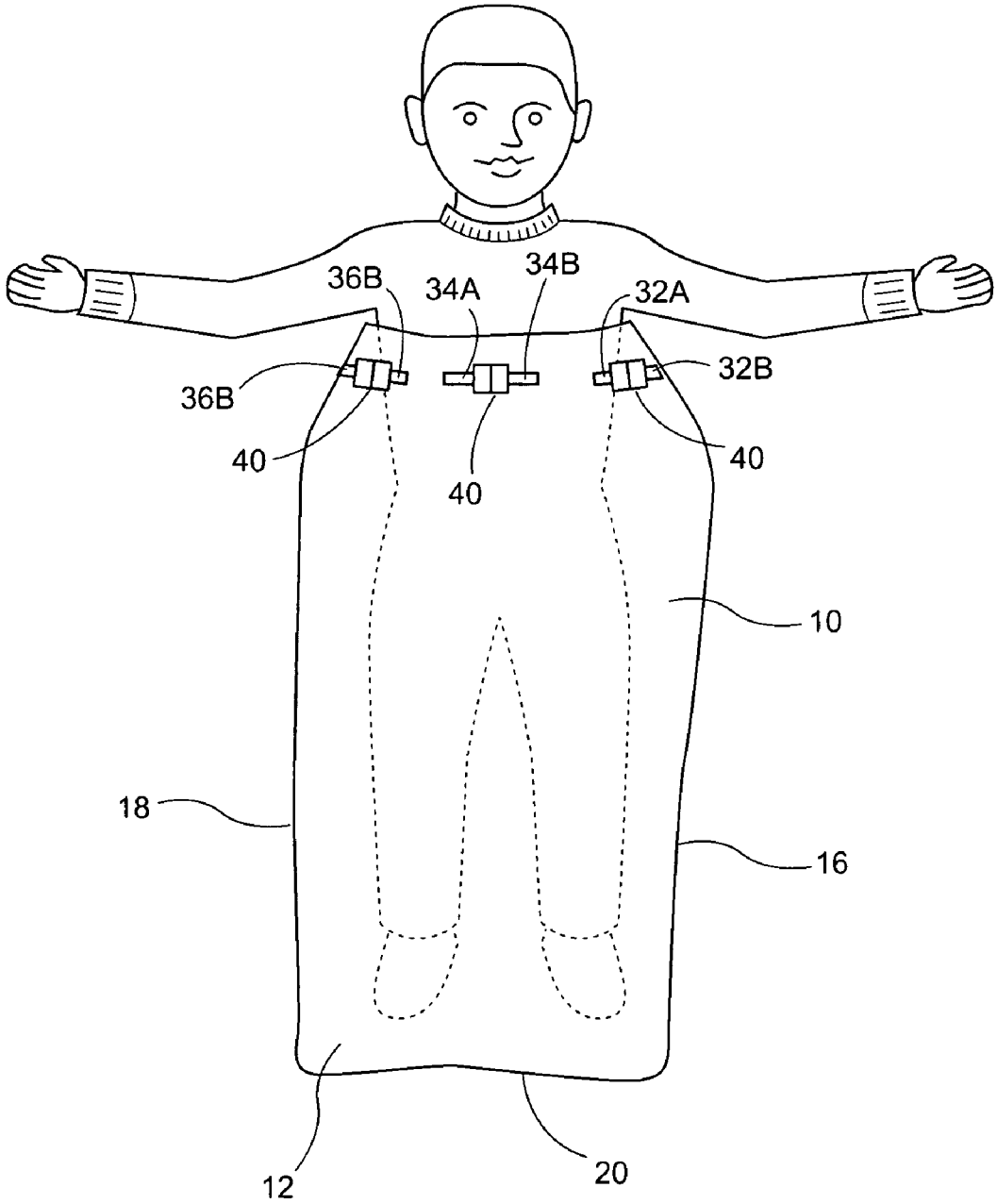
FIG. 2 is a top view of the slumber bag of FIG. 1 which has been partially opened.

In FIG. 2, a closed slumber bag 10 is shown, in which a child has been positioned. It can be seen that the straps have been connected and tighten to the degree necessary for the slumber bag to be held in position around the legs and the child's lower torso. The slumber bag opening is positioned around the chest of the child, and the child's arms, shoulders and head are outside of slumber bag 10.

Figure 3:
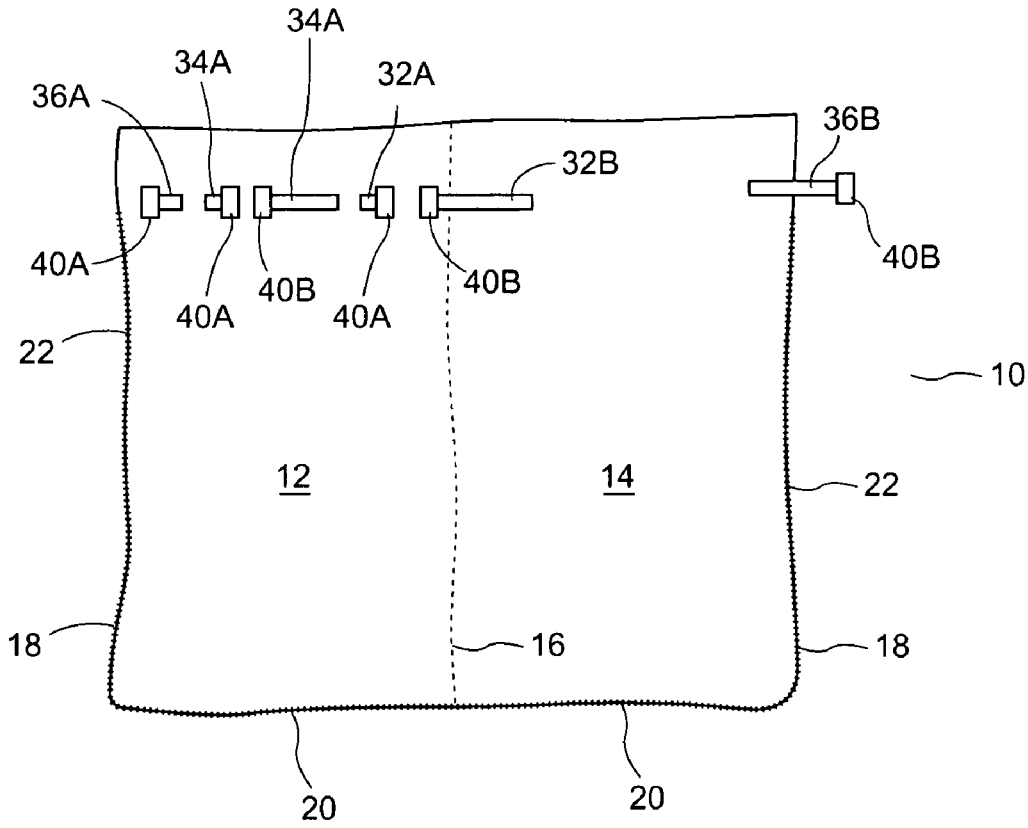
FIG. 3 is a back view of the slumber bag of FIG. 1 which has been completely opened and laid flat.

In FIG. 3, zipper 20 is completely open, and the construction of the front and back panels 12 and 14 is shown as being made from one larger panel which is folded in half to form side 16. Details of the strap attachment locations can also be seen. It should be noted that in this configuration, the slumber bag 10 can now be used as a ordinary blanket or quilt to cover the child in situations where it is not necessary to ensure that the child remains covered by using the slumber bag.

Figure 4:
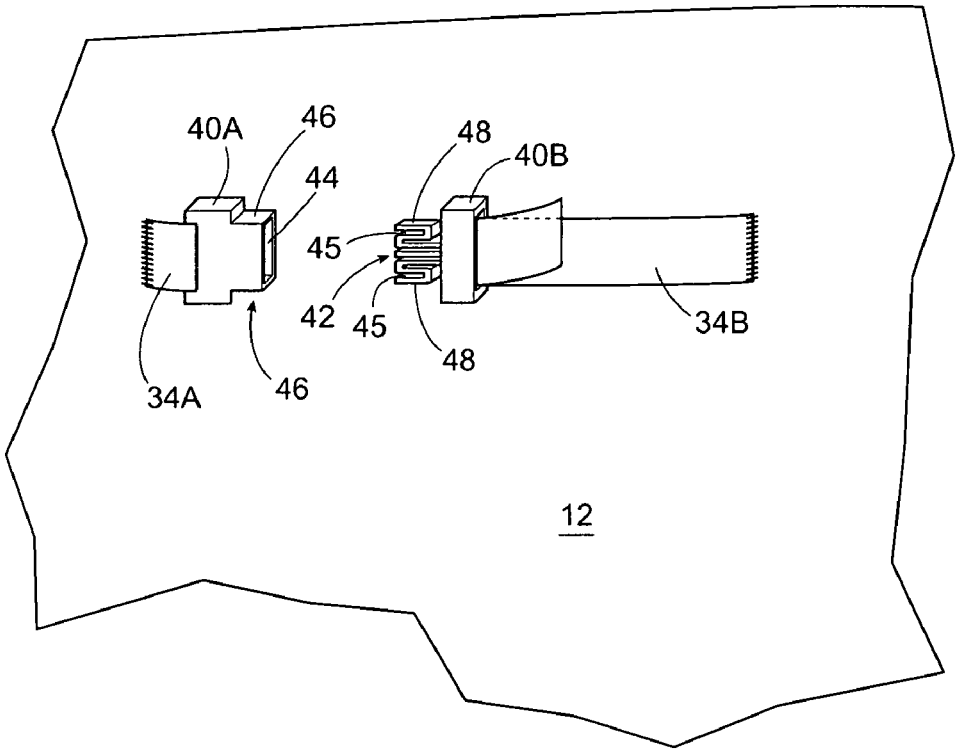
FIG. 4 is a detailed view of one pair of adjustable straps together with a preferred connector.

In FIG. 4, a detailed view of a parachute clip 40, as part of strap 34, is shown having a male section 40B, and a female section 40A, which are mated together to form a connection. Front portion 42 of section 40B is pushed into opening 44 of connector portion 40A where spring loaded sections 45 are first compressed before snapping into recesses 46 in the sides of connector 40A. Once they have snapped in position, sections 45 will not move and thus, section 40B is held within section 40A. To release the connector 40, buttons 48, on sections 45, are pushed to move sections 45 inward, and away from recesses 46. Front portion 42 can then be removed from section 40A.

Strap section 34A is sewn to panel 12 at one end, and is sewn around a first end of connector section 40A at its other end. Strap section 34B is also sewn at one end to panel 12 while its other end is "interwoven" around the end of connector section 40B. As such, the length of strap sections "B" can be adjusted by modifying the location where strap section "B" is interwoven into connector section 40B. Straps 32 and 36 are connected to bag 10 in a similar fashion except that straps 32B and 36B are sewn to back panel 14.

While the present invention provides a useful slumber bag, it will be clear that the slumber bag of the present invention can be combined with other features. These can include removable or connected pillows, sleeves, head coverings and the like. Also, the opening at the top of the slumber bag may be partially closed through the use of "darts" or the like. These darts might be opened or closed through the use of additional fasteners such as additional zippers. Also, the straps may be partially hidden by having the straps pass through "slits" or other openings on the front and/or the back panels.

Figure 5:
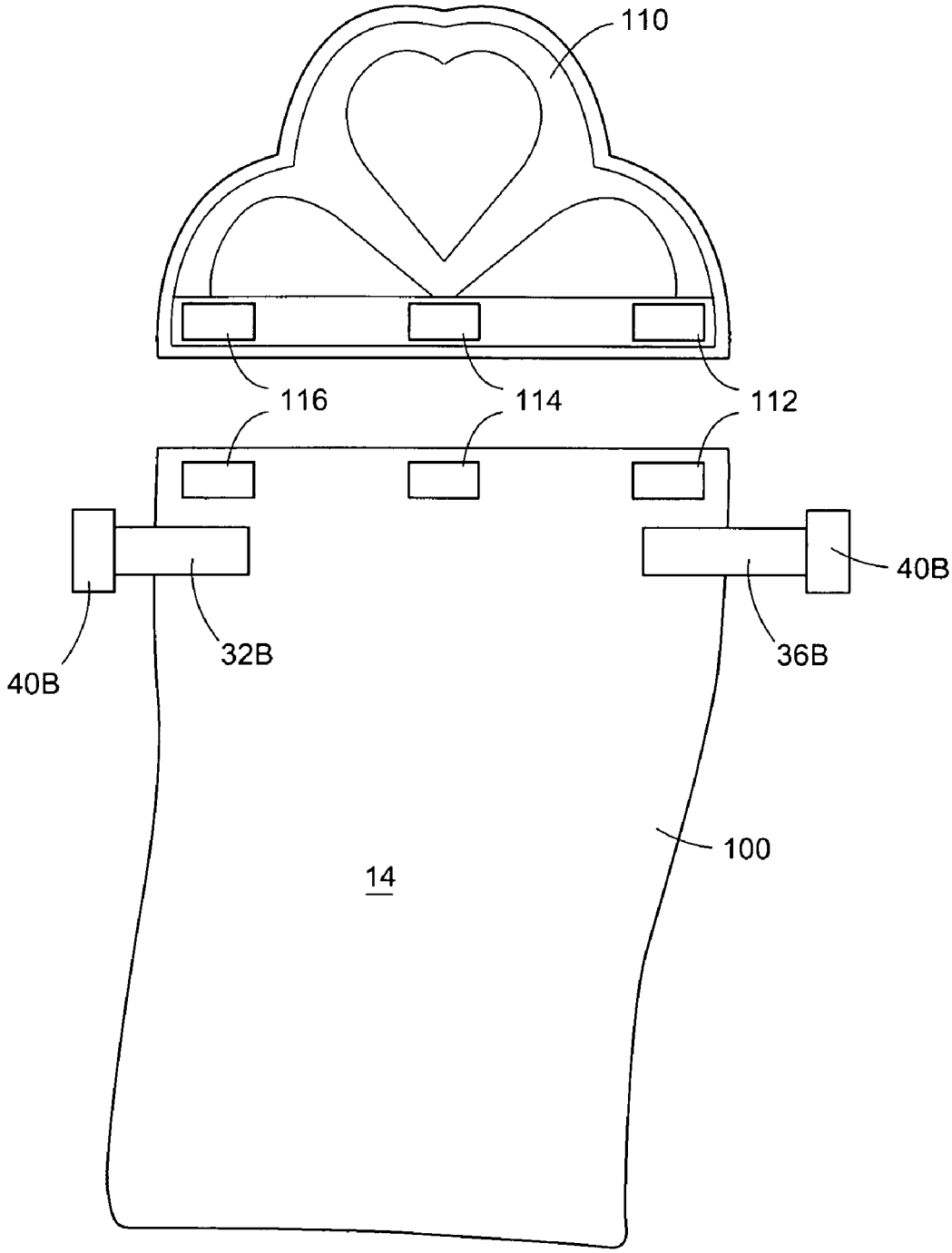
FIG. 5 is a rear view of a slumber bag with an attachable pillow.

In FIG. 5, a rear view of a slumber bag 100 is shown which is essentially identical to the slumber bag 10 of FIG. 1, with the exception that it includes an attachable "pillow" section 110. Pillow 110 can be made of any suitable material, but is preferably made of the same material as slumber bag 110. Pillow 110 can be of any suitable shape, but can have a width similar to the width of slumber bag 110, and preferably has a height of between 10 to 18 inches, and most preferably between 12 and 16 inches. Pillow 110 is attached to slumber bag 100 using three Velcro™ fasteners 112, 114 and 116 so that it is removable.

Other attachments can be similarly attached to slumber bag 10.

Also, the slumber bag of the present invention is shown with a zipper passing around the outside edges of the bag. However, the zipper might also be located in other positions, such as in the middle of the front or the back panel, or the slumber bag might be at least partially sewn together around the sides, so that only a small zipper would be desired. Further, the "common side" of the slumber bag might be the end of the slumber bag so that the larger fabric piece is folded to form the end. With this arrangement, a zipper or other fastener could be located on each side in order to close the sides.

Thus, it is apparent that there has been provided, in accordance with the present invention, a slumber bag which fully satisfies the goals, objects, and advantages set forth hereinbefore. Therefore, having described specific embodiments of the present invention, it will be understood that alternatives, modifications and variations thereof may be suggested to those skilled in the art, and that it is intended that the present specification embrace all such alternatives, modifications and variations as fall within the scope of the appended claims.

Additionally, for clarity and unless otherwise stated, the word "comprise" and variations of the word such as "comprising" and "comprises", when used in the description and claims of the present specification, is not intended to exclude other additives, components, integers or steps.

Moreover, the words "substantially" or "essentially", when used with an adjective or adverb is intended to enhance the scope of the particular characteristic; e.g., substantially planar is intended to mean planar, nearly planar and/or exhibiting characteristics associated with a planar element.

Further, use of the terms "he", "him", or "his", is not intended to be specifically directed to persons of the masculine gender, and could easily be read as "she", "her", or "hers", respectively.

Also, while this discussion has addressed prior art known to the inventor, it is not an admission that all art discussed is citable against the present application.

I claim:

1. A slumber bag for covering the legs and lower torso of a child comprising a cover portion having a front panel and a connected back panel, which front and back panels together define an opening at one end of the cover portion, and external fitting straps located at or near said opening in order to partially close said opening, wherein said fitting straps are orientated so as to be essentially parallel to the edge of said opening and comprise first and second straps on either said front and/or said back panels, at least one connector, being a parachute clip, for releasably attaching said first and second straps together; and adjustment means for adjusting the length of said first or second straps.

2. A slumber bag as claimed in claim 1 having at least two fitting straps wherein each of said fitting straps comprises at least one back strap, as said first strap, attached to said back panel, at least one front strap, as said second strap, connected to said front panel, and each of said fitting straps has a connector that releasably joins said back strap to said front strap.

3. A slumber bag as claimed in claim 1 wherein the front and back panels are joined to one another around their circumference, with the exception of the opening.

4. A slumber bag as claimed in claim 3 wherein said front and back panels are formed by folding a larger panel to form a first side, and said front and back panels are joined together at a closed end and at a second side, using a zipper.

5. A slumber bag as claimed in claim 1 wherein said child is between the ages of 6 months and 36 months.

6. A slumber bag as claimed in claim 1 additionally comprising a releasably attached pillow section connected to said back panel at or near said opening, and extending above said back panel.

7. A slumber bag as claimed in claim 2 additionally comprising a third fitting strap having a first strap and a second strap connected to said front panel, and a connector to join together said first strap and said second strap of said third fining strap.

* * * * *